US009611848B2

(12) United States Patent
Akatsuka et al.

(10) Patent No.: US 9,611,848 B2
(45) Date of Patent: Apr. 4, 2017

(54) VARIABLE DISPLACEMENT VANE PUMP HAVING CONNECTION GROOVE COMMUNICATING WITH SUCTION-SIDE BACK PRESSURE PORT THEREOF

(71) Applicant: KAYABA INDUSTRY CO., LTD., Tokyo (JP)

(72) Inventors: Koichiro Akatsuka, Gifu (JP); Tomoyuki Fujita, Gifu (JP); Fumiyasu Kato, Aichi (JP)

(73) Assignee: KYB Corporation, Tokyo (JP)

( * ) Notice: Subject to any disclaimer, the term of this patent is extended or adjusted under 35 U.S.C. 154(b) by 0 days.

(21) Appl. No.: 14/773,909

(22) PCT Filed: Feb. 27, 2014

(86) PCT No.: PCT/JP2014/054836

§ 371 (c)(1),
(2) Date: Sep. 9, 2015

(87) PCT Pub. No.: WO2014/141888

PCT Pub. Date: Sep. 18, 2014

(65) Prior Publication Data

US 2016/0017884 A1 Jan. 21, 2016

(30) Foreign Application Priority Data

Mar. 13, 2013 (JP) ..... 2013-050286

(51) Int. Cl.
*F03C 2/00* (2006.01)
*F03C 4/00* (2006.01)
(Continued)

(52) U.S. Cl.
CPC ..... *F04C 14/226* (2013.01); *F01C 21/0863* (2013.01); *F01C 21/108* (2013.01);
(Continued)

(58) Field of Classification Search
CPC ..... F04C 2/344; F04C 2/3441; F04C 2/3442; F04C 14/22; F04C 14/223; F04C 14/226;
(Continued)

(56) References Cited

U.S. PATENT DOCUMENTS 3,516,767 A * 6/1970 Perkins ..... F01C 21/0863 418/81
3,964,844 A * 6/1976 Whitmore ..... F04C 15/06 418/133
(Continued)

FOREIGN PATENT DOCUMENTS

JP 06-200883 A 7/1994
JP 2009024570 A * 2/2009 ..... F04C 2/344

*Primary Examiner* — Theresa Trieu
(74) *Attorney, Agent, or Firm* — Rabin & Berdo, P.C.

(57) ABSTRACT

A variable displacement vane pump includes a rotor, vanes, a cam ring, pump chambers, a suction port, a discharge port, back pressure chambers, a plate that has a sliding contact surface and a penetrating hole, a suction-side back pressure port being configured to guide the working fluid in the suction port to the back pressure chambers in a suction section, a discharge-side back pressure port being configured to guide the working fluid that is discharged from the discharge port to the back pressure chambers in a discharge section, an additional groove provided on the sliding contact surface so as to extend from between the discharge-side back pressure port and the penetrating hole to between the suction-side back pressure port and the penetrating hole, and a connection groove that communicates the additional groove with the suction-side back pressure port.

4 Claims, 3 Drawing Sheets

(51) Int. Cl.

| | |
|---|---|
| ***F04C 2/00*** | (2006.01) |
| ***F04C 15/00*** | (2006.01) |
| ***F04C 14/22*** | (2006.01) |
| ***F04C 29/12*** | (2006.01) |
| ***F01C 21/08*** | (2006.01) |
| ***F01C 21/10*** | (2006.01) |
| ***F04C 2/344*** | (2006.01) |
| ***F04C 15/06*** | (2006.01) |

(52) U.S. Cl.
CPC ..... *F04C 2/3442* (2013.01); *F04C 2/3448* (2013.01); *F04C 15/06* (2013.01); *F04C 29/12* (2013.01)

(58) Field of Classification Search
CPC ..... F04C 15/06; F04C 18/3564; F04C 29/12; F01C 21/0836; F01C 21/0863; F01C 21/0854; F01C 21/108
USPC ..... 418/26–31, 81, 133, 259–260
See application file for complete search history.

(56) References Cited

U.S. PATENT DOCUMENTS 5,222,886 A * 6/1993 Fischer ..... F04C 115/06 418/133
5,538,400 A 7/1996 Konishi et al.
6,481,992 B2 * 11/2002 Wong ..... F01C 21/0863 418/81

* cited by examiner

VARIABLE DISPLACEMENT VANE PUMP HAVING CONNECTION GROOVE COMMUNICATING WITH SUCTION-SIDE BACK PRESSURE PORT THEREOF

TECHNICAL FIELD

The present invention relates to a variable displacement vane pump that is used as a fluid pressure source for a fluid pressure apparatus.

BACKGROUND ART

A variable displacement vane pump includes a rotor that receives vanes, a cam ring that has an inner circumferential cam face with which tip end portions of the vanes are brought into sliding contact, a side plate that is in sliding contact with one end side of the rotor in the axial direction. On the side plate, a suction port for guiding working fluid into pump chambers that are defined by the rotor, the cam ring, and the adjacent vanes and a discharge port for guiding the working fluid discharged from the pump chambers are formed so as to have arc shapes, respectively.

Furthermore, a back pressure port that communicates with back pressure chambers defined on the base-end sides of the vanes is formed on the side plate. Working fluid pressure is supplied to the back pressure chambers through the back pressure port, and the vanes are pushed radially outward by the working fluid pressure such that tip ends of the vanes are brought into sliding contact with an inner circumference of the cam ring. In a suction section, because pressure in the pump chambers is low, the vanes are strongly pressed against the inner circumferential cam face of the cam ring by the pressure in the back pressure chambers, and thereby, a sliding resistance between the tip ends of the vanes and the inner circumferential cam face is increased.

JP6-200883A discloses a technique in which arc-shaped back pressure ports are respectively provided in a suction section and a discharge section, and low-pressure working fluid is introduced through a suction port to the back pressure port on the suction side while high-pressure working fluid discharged from a discharge port is introduced to the back pressure port on the discharge side, and thereby, a sliding resistance between vanes and inner circumferential cam face is reduced.

SUMMARY OF INVENTION

A shaft that rotationally drives a rotor is inserted into a penetrating hole provided at the center of a side plate. Because the side plate is not rotated even when the shaft is rotated, minute gaps are provided between an outer circumference of the shaft and an inner circumference of the penetrating hole. Furthermore, because the side plate is not rotated even when the rotor is rotated, minute gaps are provided between a side surface of the rotor and a side surface of the side plate.

Therefore, there is a possibility that high-pressure working fluid introduced to a back pressure port on the discharge side leaks out to the outer circumference of the shaft through the gap between the rotor and the side plate. If the working fluid leaks out, the amount of eccentricity of a cam ring is increased in order to compensate for a decrease in discharge capacity. Thereby, rotating load of the rotor is increased, and pump efficiency is deteriorated.

An object of the present invention is to provide a variable displacement vane pump that is capable of suppressing a deterioration in pump efficiency caused by the leakage of working fluid from a discharge-side back pressure port.

According to one aspect of the present invention, a variable displacement vane pump used as a fluid pressure source includes: a rotor that is linked to a shaft rotationally driven by motive force from a motive-power source; a plurality of slits formed in a radiating pattern so as to open at an outer circumference of the rotor; vanes respectively received in the slits in a freely slidable manner; a cam ring that has an inner circumferential cam face with which tip end portions of the vanes are brought into sliding contact, the cam ring capable of being made eccentric to a center of the rotor and the tip end portions being end portions of the vanes in direction projecting from the slits; pump chambers defined by the rotor, the cam ring, and the adjacent vanes; a suction port configured to guide working fluid that is to be sucked into the pump chambers; a discharge port configured to guide the working fluid that is discharged from the pump chambers; back pressure chambers formed in the slits and partitioned by base-end portions of the vanes, the base-end portions being end portions at the opposite side from the tip end portions; a plate that has a sliding contact surface and a penetrating hole, the sliding contact surface being in sliding contact with a side surface of the rotor and the penetrating hole being configured such that the shaft is inserted therein-into; a suction-side back pressure port formed on an outer circumferential side of the penetrating hole on the sliding contact surface, the suction-side back pressure port being configured to guide the working fluid in the suction port to the back pressure chambers in a suction section in which the pump chambers are in communication with the suction port; a discharge-side back pressure port formed on an outer circumferential side of the penetrating hole on the sliding contact surface, the discharge-side back pressure port being configured to guide the working fluid that is discharged from the discharge port to the back pressure chambers in a discharge section in which the pump chambers are in communication with the discharge port; an additional groove provided on the sliding contact surface so as to extend from between the discharge-side back pressure port and the penetrating hole to between the suction-side back pressure port and the penetrating hole; and a connection groove that communicates the additional groove with the suction-side back pressure port.

DESCRIPTION OF EMBODIMENT

An embodiment of the present invention will be described below with reference to the attached drawings.

Figure 1:
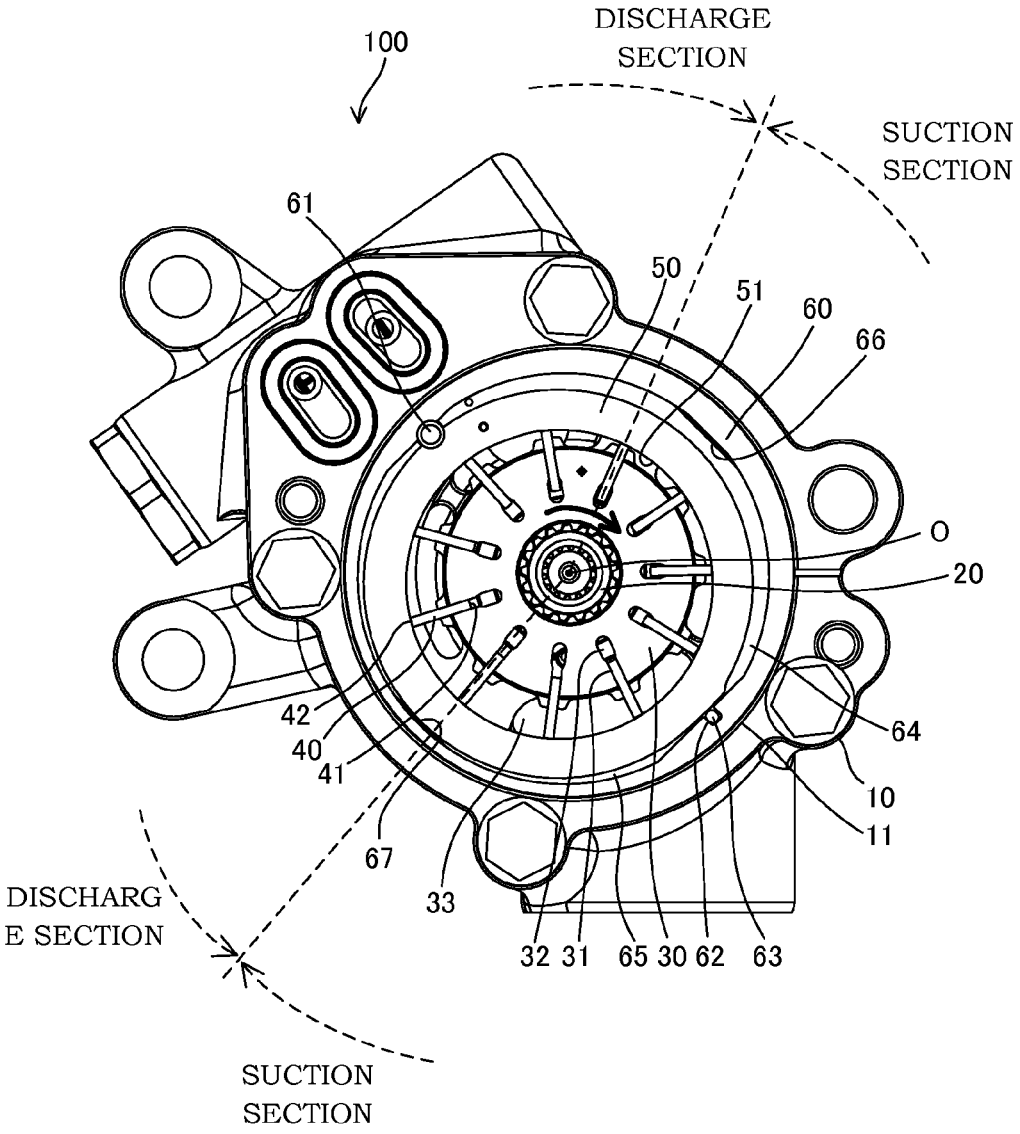
FIG. 1 is a front view showing a variable displacement vane pump according to an embodiment of the present invention.
Figure 2:
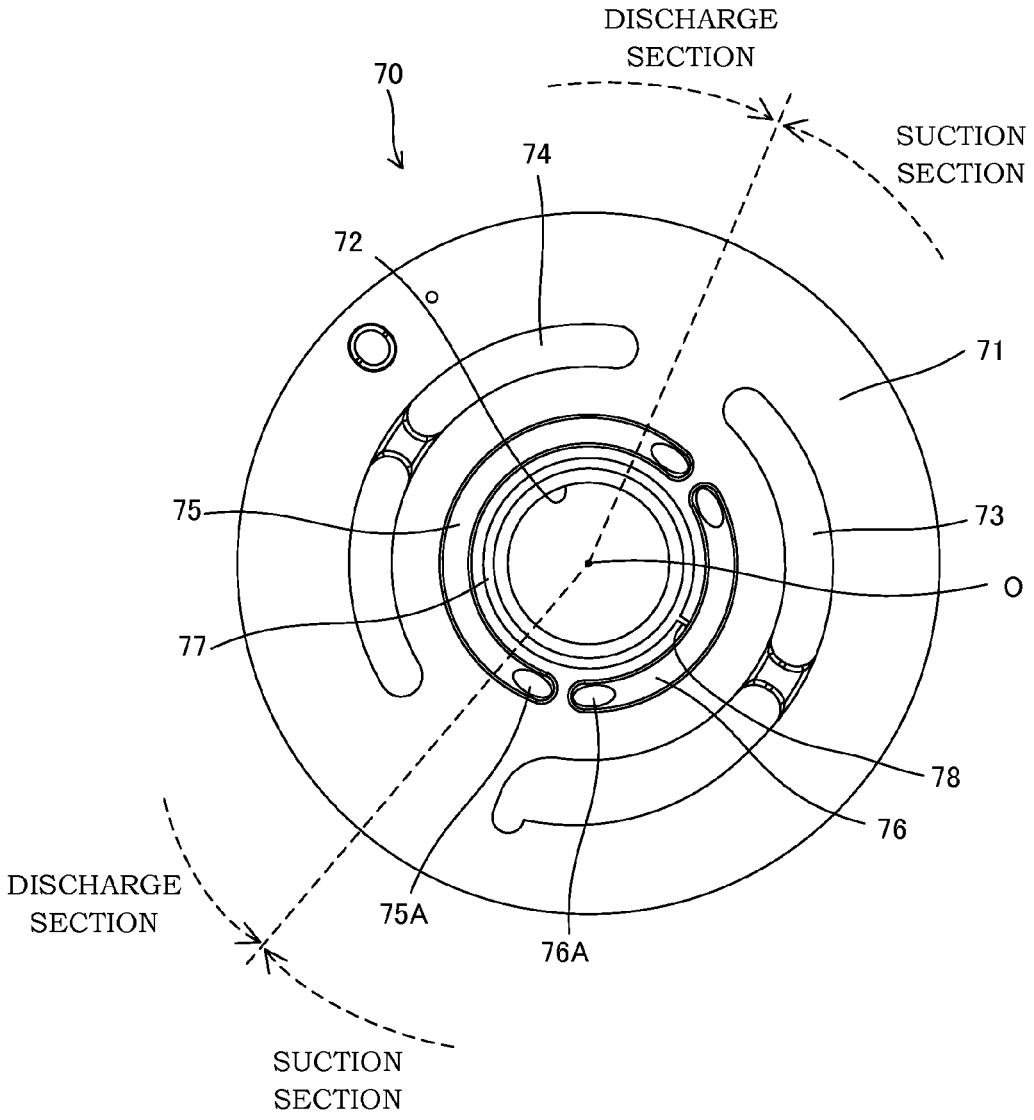
FIG. 2 is a front view of a side plate.
Figure 3:
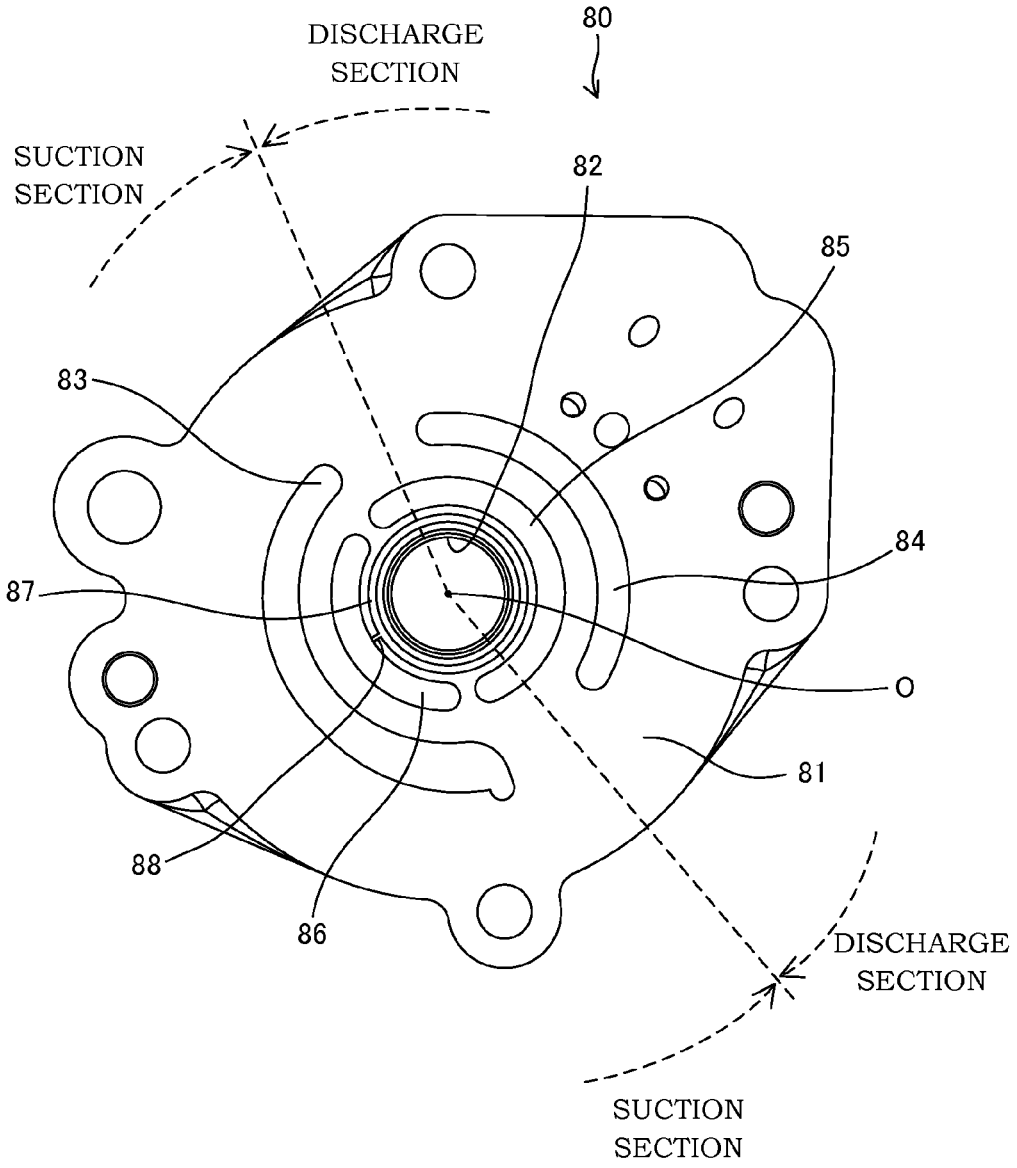
FIG. 3 is a front view of a pump cover.

FIG. 1 is a front view of a variable displacement vane pump 100 (hereinafter, simply referred to as "vane pump 100") according to this embodiment and is a diagram in which the vane pump 100 is viewed from the axial direction of a shaft 20 in a state in which a pump cover 80 has been detached. FIG. 2 is a front view of a side plate 70 and is a diagram viewed from the same direction as that in FIG. 1. FIG. 3 is a front view of the pump cover 80 and is a diagram showing a state in which the pump cover 80 that has been detached from the vane pump 100 shown in FIG. 1 is turned over about the axis along the up and down direction of the plane of figure.

The vane pump 100 is used as a fluid pressure source for a fluid pressure apparatus, such as, for example, a power steering apparatus, a continuously variable transmission, or the like, mounted on a vehicle. Oil, aqueous alternative fluid of other type, or the like may be used as working fluid.

The vane pump 100 is driven by an engine (not shown) etc., for example, and generates fluid pressure as a rotor 30 that is linked to the shaft 20 is rotated clockwise as shown by an arrow in FIG. 1.

The vane pump 100 includes a pump body 10, the shaft 20 that is rotatably supported by the pump body 10, the rotor 30 that is rotationally driven by being linked to the shaft 20, a plurality of vanes 40 that are provided so as to be capable of reciprocating in the radial direction relative to the rotor 30, a cam ring 50 that accommodates the rotor 30 and the vanes 40, and an annular adapter ring 60 that surrounds the cam ring 50.

In the rotor 30, a plurality of slits 31 having openings on the outer circumferential surface of the rotor 30 are formed in a radiating pattern with predetermined gaps therebetween. The vanes 40 are respectively inserted into the slits 31 in a freely slidable manner. At the base-end sides of the slits 31, back pressure chambers 32 are formed by being defined by base-end portions 41 of the vanes 40, which are end portions at the opposite sides from the directions in which the vanes 40 project out from the slits 31, and the working fluid is guided to the back pressure chambers 32. The vanes 40 are pushed in the directions in which the vanes 40 project out from the slits 31 by the pressure in the back pressure chambers 32.

In the pump body 10, a pump accommodating concaved portion 11 accommodating the adapter ring 60 is formed. The side plate 70 (see FIG. 2) is arranged on a bottom surface of the pump accommodating concaved portion 11 so as to be in contact with the one side in the axial direction (back side in FIG. 1) of each of the rotor 30, the cam ring 50, and the adapter ring 60. An opening of the pump accommodating concaved portion 11 is closed with the pump cover 80 (see FIG. 3) that is in contact with the other side (front side in FIG. 1) of each of the rotor 30, the cam ring 50, and the adapter ring 60. The pump cover 80 and the side plate 70 are arranged in a state in which both side surfaces of each of the rotor 30, the cam ring 50, and the adapter ring 60 are sandwiched. Pump chambers 33 are defined between the rotor 30 and the cam ring 50 by being partitioned by the respective vanes 40.

As shown in FIG. 2, on the side plate 70, a penetrating hole 72 for inserting the shaft 20, a suction port 73 for guiding the working fluid into the pump chambers 33, and a discharge port 74 for discharging the working fluid in the pump chambers 33 and guiding it to the fluid pressure apparatus are formed on a sliding contact surface 71 that is in sliding contact with the rotor 30. The suction port 73 and the discharge port 74 are individually formed so as to have arc shapes centered at the penetrating hole 72.

As shown in FIG. 3, the pump cover 80, a penetrating hole 82, a suction port 83, and a discharge port 84 are formed on a sliding contact surface 81 that is in sliding contact with the rotor 30 at positions symmetrical to those on the side plate 70, respectively. In other words, the suction port 83 of the pump cover 80 is in communication with the suction port 73 of the side plate 70 through the pump chambers 33, and the discharge port 84 of the pump cover 80 is in communication with the discharge port 74 of the side plate 70 through the pump chambers 33. Furthermore, the penetrating hole 82 of the pump cover 80 is arranged so as to be coaxial with the penetrating hole 72 of the side plate 70.

Referring back to FIG. 1, the cam ring 50 is an annular member and has an inner circumferential cam face 51 with which tip end portions 42 of the vanes 40, which are end portions of the vanes 40 in the directions in which the vanes 40 project out from the slits 31, are brought into sliding contact. On the inner circumferential cam face 51, a suction section in which the working fluid is sucked through the suction ports 73 and 83 by the rotation of the rotor 30 and a discharge section in which the working fluid is discharged through the discharge ports 74 and 84 by the rotation of the rotor 30 are formed.

The suction port 73 is formed so as to penetrate the side plate 70 and to communicate with a tank (not shown)through a suction passage (not shown) formed on the pump body 10, and the working fluid in the tank is supplied from the suction port 73 of the side plate 70 to the pump chambers 33 through the suction passage.

The discharge port 74 is formed so as to penetrate the side plate 70 and to communicate with a high-pressure chamber (not shown) formed on the pump body 10. The high-pressure chamber is communicated with the fluid pressure apparatus (not shown) outside the vane pump 100 through a discharge passage (not shown). In other words, the working fluid discharged from the pump chambers 33 is supplied to the fluid pressure apparatus through the discharge port 74, the high-pressure chamber, and the discharge passage.

The adapter ring 60 is accommodated in the pump accommodating concaved portion 11 of the pump body 10. A support pin 61 is interposed between the adapter ring 60 and the cam ring 50. The cam ring 50 is supported by the support pin 61 such that the cam ring 50 swings about the support pin 61 inside the adapter ring 60, and thereby, the cam ring 50 is made eccentric to the center O of the shaft 20.

A seal member 63 is interposed in a groove 62 of the adapter ring 60, and the seal member 63 is brought into sliding contact with the outer circumferential surface of the cam ring 50 when the cam ring 50 swings. A first fluid pressure chamber 64 and a second fluid pressure chamber 65 are partitioned by the support pin 61 and the seal member 63 in a space between the outer circumferential surface of the cam ring 50 and the inner circumferential surface of the adapter ring 60.

The cam ring 50 swings about the support pin 61 by a pressure difference between the first fluid pressure chamber 64 and the second fluid pressure chamber 65. As the cam ring 50 swings, the amount of eccentricity of the cam ring 50 with respect to the rotor 30 is changed, and the discharge capacity of the pump chambers 33 is changed. When the cam ring 50 swings counterclockwise about the support pin 61 in FIG. 1, the amount of eccentricity of the cam ring 50 with respect to the rotor 30 is reduced, and thus, the discharge capacity of the pump chambers 33 is decreased. In contrast, as shown in FIG. 1, when the cam ring 50 swings clockwise about the support pin 61, the amount of eccentricity of the cam ring 50 with respect to the rotor 30 is increased, and thus, the discharge capacity of the pump chambers 33 is increased.

A restricting portion 66 that restricts movement of the cam ring 50 in the direction in which the amount of eccentricity with respect to the rotor 30 is reduced and a restricting portion 67 that restricts movement of the cam ring 50 in the direction in which the amount of eccentricity with respect to the rotor 30 is increased are respectively formed on the inner circumferential surface of the adapter ring 60 in a swelled manner. In other words, the restricting portion 66 defines the minimum amount of eccentricity of the cam ring 50 with respect to the rotor 30, and the restricting portion 67 defines the maximum amount of eccentricity of the cam ring 50 with respect to the rotor 30.

The pressure difference between the first fluid pressure chamber 64 and the second fluid pressure chamber 65 is controlled by a control valve (not shown). The control valve controls the working fluid pressure in the first fluid pressure chamber 64 and the working fluid pressure in the second fluid pressure chamber 65 such that the amount of eccentricity of the cam ring 50 with respect to the rotor 30 is reduced with the increase in the rotation speed of the rotor 30.

Back pressure ports for guiding the working fluid to the back pressure chambers 32 will be described below.

As shown in FIG. 2, on the side plate 70, a discharge-side back pressure port 75 that is in communication with the back pressure chambers 32 in the discharge section and suction-side back pressure port 76 that is in communication with the back pressure chambers 32 in the suction section are formed.

The discharge-side back pressure port 75 and the suction-side back pressure port 76 are formed so as to have arc shapes having substantially the same radius of curvature and centered at the center O of the shaft 20. The discharge-side back pressure port 75 is formed in the discharge section so as to extend over the whole region of the discharge section such that both ends of the discharge-side back pressure port 75 individually extend into the suction section. The suction-side back pressure port 76 is formed in a region in the suction section that does not interfere with the discharge-side back pressure port 75. In other words, the discharge-side back pressure port 75 and the suction-side back pressure port 76 are provided such that their ends are separated from each other without being communicated.

The discharge-side back pressure port 75 communicates with the high-pressure chamber through through-holes 75A that penetrate through the side plate 70. The high-pressure working fluid is supplied to the discharge-side back pressure port 75 from the high-pressure chamber. On the other hand, the suction-side back pressure port 76 communicates with the suction passage through through-holes 76A that penetrate through the side plate 70. The low-pressure working fluid is supplied to the suction-side back pressure port 76 from the suction passage.

As shown in FIG. 3, on the pump cover 80, a discharge-side back pressure port 85 and a suction-side back pressure port 86 are formed at respective positions symmetrical to those on the side plate 70. The high-pressure working fluid is supplied to the discharge-side back pressure port 85 from the discharge-side back pressure port 75 of the side plate 70 through the back pressure chambers 32. Similarly, the low-pressure working fluid is supplied to the suction-side back pressure port 86 from the suction-side back pressure port 76 of the side plate 70 through the back pressure chambers 32.

In the above-described configuration, the working fluid pressure discharged from the pump chambers 33 is guided to the discharge port 74, the high-pressure chamber, the through-holes 75A, and the discharge-side back pressure port 75, and the high-pressure working fluid is then guided to the back pressure chambers 32. On the other hand, the working fluid pressure introduced to the pump chambers 33 is guided to the suction passage, the through-holes 76A, and the suction-side back pressure port 76, and the low-pressure working fluid is guided to the back pressure chambers 32.

When the vane pump 100 is operated, the vanes 40 are biased in the directions in which the vanes 40 project out from the slits 31 by a biasing force by the working fluid pressure in the back pressure chambers 32 that pushes the base-end portions 41 of the vanes 40 and by the centrifugal force that is caused by the rotation of the rotor 30, and thereby, the tip end portions 42 of the vanes 40 are brought into sliding contact with the inner circumferential cam face 51 of the cam ring 50.

In the suction section, because the working fluid pressure in the back pressure chambers 32 and the working fluid pressure in the pump chambers 33 are substantially the same, the vanes 40 slide in the directions in which the vanes 40 project from the rotor 30 towards the cam ring 50 mainly by the centrifugal force generated by the rotation of the rotor 30. Because the vanes 40 that are in sliding contact with the inner circumferential cam face 51 project so as to follow along the inner circumferential cam face 51, the pump chambers 33 are expanded, and the working fluid is sucked from the suction port 73 into the pump chambers 33.

In addition, in the discharge section, because the working fluid pressure in the back pressure chambers 32 is high, the vanes 40 are pushed in the directions in which the vanes 40 project towards the cam ring 50 from the rotor 30. Because the vanes 40 that are in sliding contact with the inner circumferential cam face 51 are pushed back into the rotor 30 while following along the inner circumferential cam face 51, the pump chambers 33 are contracted, and the working fluid that has been pressurized in the pump chambers 33 is discharged from the discharge port 74.

Here, because the side plate 70 and the pump cover 80 are individually arranged so as to be in sliding contact with the rotor 30 at both side surfaces of the rotor 30, minute gaps are formed between the rotor 30 and each of the side plate 70 and the pump cover 80. Furthermore, because the shaft 20 is inserted into the penetrating holes 72 and 82 provided at the centers of the side plate 70 and the pump cover 80, minute gaps are also formed between the outer circumference of the shaft 20 and each of the inner circumferences of the penetrating holes 72 and 82.

Because the interiors of the discharge-side back pressure ports 75 and 85 are filled with the high-pressure working fluid, there is a possibility that this working fluid leaks out from the discharge-side back pressure ports 75 and 85 to the inner circumferential side and to the outside of the vane pump 100 through the outer circumference of the shaft 20.

If the working fluid in the discharge-side back pressure ports 75 and 85 leaks out, the discharge capacity of the vane pump 100 is decreased. Therefore, in order to compensate for the decrease in discharge capacity, the working fluid pressure in the first fluid pressure chamber 64 and the working fluid pressure in the second fluid pressure chamber 65 are controlled with the control valve so as to increase the amount of eccentricity of the cam ring 50. By doing so, a rotating load of the rotor 30 is increased, causing the pump efficiency to be deteriorated.

Thus, in this embodiment, as shown in FIGS. 2 and 3, ring-shaped additional grooves 77 and 87 are respectively provided on the sliding contact surfaces 71 and 81 of the side plate 70 and the pump cover 80 at the inner circumferential side of the discharge-side back pressure ports 75 and 85 and the suction-side back pressure ports 76 and 86, and at the outer circumferential side of the penetrating holes 72 and 82. Furthermore, connection grooves 78 and 88, which are narrowed to have groove widths smaller than those of the additional grooves 77 and 87, are respectively provided in the additional grooves 77 and 87 at positions that face the suction-side back pressure ports 76 and 86 such that the additional grooves 77 and 87 are communicated with the suction-side back pressure ports 76 and 86. In other words, the connection grooves 78 and 88 are formed so as to have cross-sectional areas smaller than those of the additional grooves 77 and 87.

With such a configuration, because the additional grooves 77 and 87 are communicated with the suction-side back pressure ports 76 and 86 through the connection grooves 78 and 88, the pressure in the additional grooves 77 and 87 becomes lower than that in the discharge-side back pressure ports 75 and 85. Therefore, the high-pressure working fluid that has leaked out from the discharge-side back pressure ports 75 and 85 to the inner circumferential side is sucked into the additional grooves 77 and 87. The working fluid that has been sucked into the additional grooves 77 and 87 flows towards the suction section side along the additional grooves 77 and 87, and returns to the suction-side back pressure ports 76 and 86 through the connection grooves 78 and 88.

As described above, because the high-pressure working fluid that has leaked out from the discharge-side back pressure ports 75 and 85 is returned to the suction-side back pressure ports 76 and 86 whose pressure is low, the pressure difference between the discharge pressure and the suction pressure is made small. Therefore, even if the amount of eccentricity of the cam ring 50 is increased by an amount corresponding to the amount compensating for the leakage of the working fluid, the increase in the rotating load of the rotor 30 is suppressed, and thereby, the deterioration of the pump efficiency is suppressed.

Furthermore, because the connection grooves 78 and 88 are narrowed so as to have the groove widths that are smaller than those of the additional grooves 77 and 87, the working fluid pressure in the additional grooves 77 and 87 is kept higher than that in the suction-side back pressure ports 76 and 86. Therefore, the air outside the vane pump 100 is prevented from being sucked into the additional grooves 77 and 87 from the outer circumference of the shaft 20.

According to the embodiment mentioned above, the advantages described below are afforded.

Because the ring-shaped additional grooves 77 and 87 are respectively provided on the sliding contact surfaces 71 and 81 of the side plate 70 and the pump cover 80 at the inner circumferential side of the discharge-side back pressure ports 75 and 85 and at the outer circumferential side of the penetrating holes 72 and 82, and because the connection grooves 78 and 88 that communicate the additional grooves 77 and 87 with the suction-side back pressure ports 76 and 86, respectively, are provided, it is possible to suck the high-pressure working fluid that has leaked out from the discharge-side back pressure ports 75 and 85 into the additional grooves 77 and 87, and to return the working fluid to the suction-side back pressure ports 76 and 86 through the connection grooves 78 and 88.

Therefore, because the pressure difference between the discharge pressure and the suction pressure is made small, it is possible to suppress the increase in the rotating load of the rotor 30 and to suppress the deterioration of the pump efficiency even if the amount of eccentricity of the cam ring 50 is increased by an amount corresponding to the amount compensating for the leakage of the working fluid from the discharge-side back pressure ports 75 and 85.

Furthermore, because the cross-sectional areas of the connection grooves 78 and 88 are made smaller than those of the additional grooves 77 and 87 by narrowing the groove widths of the connection grooves 78 and 88, a part of the high-pressure working fluid that has leaked out from the discharge-side back pressure ports 75 and 85 is retained in the additional grooves 77 and 87, and it is possible to keep the pressure in the additional grooves 77 and 87 higher than that in the suction-side back pressure ports 76 and 86. Therefore, it is possible to prevent the pressure in the additional grooves 77 and 87 from being decreased and to prevent the outside air from being sucked into the additional grooves 77 and 87 through the gaps formed around the outer circumference of the shaft 20.

Furthermore, because the additional grooves 77 and 87 are respectively provided so as to have ring shapes over the entire outer circumferential side of the penetrating holes 72 and 82 on the sliding contact surfaces 71 and 81 of the side plate 70 and the pump cover 80, it is possible to reliably suck the working fluid that has leaked out from the discharge-side back pressure ports 75 and 85 into the additional grooves 77 and 87 over the entire circumference regardless of the leakage locations.

Embodiments of this invention were described above, but the above embodiments are merely examples of applications of this invention, and the technical scope of this invention is not limited to the specific constitutions of the above embodiments.

For example, in the above-mentioned embodiment, although the additional grooves 77 and 87 and the connection grooves 78 and 88 are respectively provided on the side plate 70 and the pump cover 80, they may only be provided on either one of the side plate 70 and the pump cover 80.

This application claims priority based on Japanese Patent Application No. 2013-50286 filed with the Japan Patent Office on Mar. 13, 2013, the entire contents of which are incorporated into this specification.

The invention claimed is:

1. A variable displacement vane pump used as a fluid pressure source comprising:

a rotor that is linked to a shaft rotationally driven by motive force from a motive-power source;

a plurality of slits formed in a radiating pattern so as to open at an outer circumference of the rotor;

vanes respectively received in the slits in a freely slidable manner;

a cam ring that has an inner circumferential cam face with which tip end portions of the vanes are brought into sliding contact, the cam ring is made eccentric to a center of the rotor and the tip end portions being end portions of the vanes in direction projecting from the slits;

pump chambers defined by the rotor, the cam ring, and the adjacent vanes;

a suction port configured to guide working fluid that is to be sucked into the pump chambers;

a discharge port configured to guide the working fluid that is discharged from the pump chambers;

back pressure chambers formed in the slits and partitioned by base-end portions of the vanes, the base-end portions being end portions at the opposite side from the tip end portions;

a plate that has a sliding contact surface and a penetrating hole, the sliding contact surface being in sliding contact with a side surface of the rotor and the penetrating hole being configured such that the shaft is inserted therein into;

a suction-side back pressure port formed on an outer circumferential side of the penetrating hole on the sliding contact surface, the suction-side back pressure port being configured to guide the working fluid in the suction port to the back pressure chambers in a suction section in which the pump chambers are in communication with the suction port;

a discharge-side back pressure port formed on an outer circumferential side of the penetrating hole on the sliding contact surface, the discharge-side back pressure port being configured to guide the working fluid that is discharged from the discharge port to the back pressure chambers in a discharge section in which the pump chambers are in communication with the discharge port;

both ends of the suction-side back pressure port and the discharge-side back pressure port are separated from each other, without being communicated;

an additional groove provided on the sliding contact surface so as to extend from between the discharge-side back pressure port and the penetrating hole to between the suction-side back pressure port and the penetrating hole; and a connection groove that communicates the additional groove with the suction-side back pressure port.

2. The variable displacement vane pump according to claim 1, wherein a cross-sectional area of the connection groove is smaller than a cross-sectional area of the additional groove.

3. The variable displacement vane pump according to claim 1, wherein the additional groove is formed so as to have a ring shape over the entire outer circumferential side of the penetrating hole on the sliding contact surface.

4. The variable displacement vane pump according to claim 1, wherein the plate is provided on at least one of side surfaces of the rotor.

* * * * *